US009138655B2

(12) United States Patent
Yeung et al.

(10) Patent No.: US 9,138,655 B2
(45) Date of Patent: Sep. 22, 2015

(54) EXPANDABLE PLAYSET

(71) Applicant: Mattel, Inc., El Segundo, CA (US)

(72) Inventors: Kwok Shing Yeung, Ma On Shan (HK); James M Geirczak, Santa Monica, CA (US)

(73) Assignee: Mattel, Inc., El Segundo, CA (US)

( * ) Notice: Subject to any disclaimer, the term of this patent is extended or adjusted under 35 U.S.C. 154(b) by 60 days.

(21) Appl. No.: 14/101,133

(22) Filed: Dec. 9, 2013

(65) Prior Publication Data

US 2015/0157952 A1 Jun. 11, 2015

(51) Int. Cl.

| | |
|---|---|
| ***A63H 3/52*** | (2006.01) |
| ***A63H 33/42*** | (2006.01) |
| *A63H 33/00* | (2006.01) |

(52) U.S. Cl.

CPC . *A63H 33/42* (2013.01); *A63H 3/52* (2013.01)

(58) Field of Classification Search

CPC ..... A63H 3/00; A63H 3/52; A63H 33/00; A63H 33/008; A63G 13/00; A63G 13/04; A63G 13/08

USPC ..... 446/476, 478, 486, 487; 472/103, 105

See application file for complete search history.

(56) References Cited

U.S. PATENT DOCUMENTS

| | | | | |
|---|---|---|---|---|
| 739,669 | A | | 9/1903 | Grimm |
| 990,918 | A | | 5/1911 | Stadler |
| 992,337 | A | | 5/1911 | Butler |
| 1,128,031 | A | | 2/1915 | Needleman |
| 1,343,065 | A | | 6/1920 | Suyehiro |
| 1,386,423 | A | | 8/1921 | Rapson |
| 1,428,405 | A | | 9/1922 | Wegener |
| 1,517,030 | A | | 11/1924 | Talcott |
| 1,551,666 | A | | 9/1925 | Jensen et al. |
| 1,567,849 | A | | 12/1925 | Kliner |
| 1,844,816 | A | | 2/1932 | Brown |
| 1,913,797 | A | | 6/1933 | Dulin et al. |
| 1,992,618 | A | | 2/1935 | Jeffreys |
| 2,104,628 | A | | 1/1938 | Warren |
| 2,511,211 | A | | 6/1950 | Klein et al. |
| 2,544,783 | A | | 3/1951 | Freedman et al. |
| 2,608,726 | A | | 9/1952 | Olson |
| 2,668,579 | A | * | 2/1954 | Swengel ..... 472/105 |
| 2,730,827 | A | | 1/1956 | Patterson |
| 3,363,360 | A | | 1/1968 | Ryan |
| 3,691,671 | A | | 9/1972 | Kroll |
| 3,736,695 | A | | 6/1973 | Wannan |
| 3,768,175 | A | | 10/1973 | Hill et al. |
| 3,888,039 | A | | 6/1975 | Snyder et al. |

(Continued)

FOREIGN PATENT DOCUMENTS

| | | |
|---|---|---|
| EP | 1893048 B1 | 8/2009 |
| GB | 2159721 A | 12/1985 |

(Continued)

*Primary Examiner* — Kien Nguyen

(74) *Attorney, Agent, or Firm* — Kolisch Hartwell, PC

(57) ABSTRACT

An expandable playset that provides a setting for imaginative play with character toys. The playset includes a base and a platform connected by pivoting supports and is convertible between a collapsed configuration wherein the platform rests on the base, and an expanded configuration wherein the platform is held a substantial distance above the base by the pivoting supports. A play area is accessible between the platform and the base when the playset is in the expanded configuration, but is not accessible when the playset is in the collapsed configuration.

20 Claims, 4 Drawing Sheets

(56) References Cited

U.S. PATENT DOCUMENTS

| | | | | |
|---|---|---|---|---|
| 3,906,659 | A | 9/1975 | Walmer | |
| 4,030,234 | A | 6/1977 | Allen et al. | |
| 4,349,983 | A | 9/1982 | Kilroy et al. | |
| 4,508,519 | A | 4/1985 | Becker | |
| 4,693,466 | A * | 9/1987 | Swengel, Sr. | 472/105 |
| 4,755,159 | A | 7/1988 | Templeton et al. | |
| 4,883,443 | A | 11/1989 | Chase | |
| 4,964,249 | A | 10/1990 | Payne | |
| 5,004,445 | A | 4/1991 | Coleman et al. | |
| 5,055,083 | A | 10/1991 | Walker et al. | |
| 5,417,603 | A | 5/1995 | De Chazal | |
| 5,542,870 | A | 8/1996 | Westersund | |
| 5,562,520 | A | 10/1996 | Pridonoff et al. | |
| 5,738,589 | A * | 4/1998 | Hall | 472/103 |
| 5,830,033 | A | 11/1998 | Piron | |
| 5,971,833 | A | 10/1999 | Rasmussen et al. | |
| 6,099,380 | A | 8/2000 | Rasmussen | |
| 6,283,819 | B1 | 9/2001 | Polinger et al. | |
| 6,565,413 | B2 | 5/2003 | Brownrigg | |
| 6,572,436 | B1 | 6/2003 | So | |
| 6,852,000 | B2 | 2/2005 | Lee et al. | |
| 7,467,985 | B2 | 12/2008 | Manrique | |
| 7,594,844 | B2 | 9/2009 | Cartlidge et al. | |
| 7,607,962 | B2 | 10/2009 | Hardin | |
| 7,618,301 | B2 | 11/2009 | Knight et al. | |
| 7,753,753 | B2 | 7/2010 | Payne et al. | |
| 8,021,207 | B2 | 9/2011 | Manrique | |
| 8,251,224 | B2 | 8/2012 | Meger | |
| 8,303,369 | B2 | 11/2012 | Smith et al. | |
| 8,328,596 | B2 | 12/2012 | Payne | |
| 8,784,153 | B2 * | 7/2014 | Sugimoto et al. | 446/72 |
| 2006/0014472 | A1 | 1/2006 | Spielberger | |
| 2006/0040582 | A1 | 2/2006 | Hopper et al. | |
| 2009/0075560 | A1 | 3/2009 | Smith et al. | |
| 2010/0075573 | A1 | 3/2010 | Dubois | |
| 2010/0255749 | A1 | 10/2010 | Lines | |
| 2012/0045965 | A1 | 2/2012 | Zhou et al. | |
| 2012/0064796 | A1 | 3/2012 | Manrique | |
| 2012/0276810 | A1 | 11/2012 | Grafton et al. | |
| 2013/0017757 | A1 | 1/2013 | Smith et al. | |

FOREIGN PATENT DOCUMENTS

| | | | |
|---|---|---|---|
| GB | 2178331 | A | 2/1987 |
| GB | 2159721 | B | 12/1988 |
| GB | 2440656 | A | 6/2008 |
| WO | 9709102 | A1 | 3/1997 |
| WO | 2009093814 | A2 | 7/2009 |

* cited by examiner

EXPANDABLE PLAYSET

FIELD OF THE DISCLOSURE

The present disclosure relates to an expandable playset for play with characters, such as dolls, action figures, and other toys. The playset includes at least two levels, a first level, also referred to as a base and a second level, also referred to as an upper platform. The playset is movable into two configurations, a first position in which the playset is collapsed, and the base is hidden beneath the upper platform, and a second configuration in which the playset is expanded and the upper platform is held above the base by a plurality of pivoting supports.

BACKGROUND OF THE DISCLOSURE

Many playsets are available that provide environments for play with character toys such as dolls. Typically, such playsets provide a user a single environment, such as a house; and the user develops imaginative scenarios for character toys to interact in such an environment. A significant advantage is gained if the playset is transformable, allowing a user to expand imaginative scenarios to multiple environments.

Examples of such systems are disclosed in U.S. Pat. No. 4,349,983, U.S. Pat. No. 6,099,380, U.S. Pat. No. 7,618,301, U.S. Pat. No. 7,753,753, U.S. Pat. No. 8,251,224, U.S. Pat. No. 8,328,596, and Patent Application Nos. US20120045965 and US20120276810. The disclosures of these and all other publications referenced herein are incorporated by reference in their entirety for all purposes.

SUMMARY OF THE DISCLOSURE

The present disclosure describes a playset having at least two levels. The playset is convertible between a first configuration and a second configuration, a first configuration in which the playset is collapsed, and a first level is hidden beneath a second level, and a second configuration in which the playset is expanded and the second level is held above the first level by a plurality of pivoting supports. In some embodiments, a pivot connects each pivoting support to a base. Furthermore, in some embodiments, a spring-loaded pin mechanism releasably locks at least one pivoting support in a generally vertical position relative to the base, when the playset is expanded, so that the second level is held above the first level by the at least one pivoting support.

Like many playsets, the playsets of the present disclosure provide a setting for creative play with character toys such as dolls, action figures, stuffed animals, and with other toys such as toy vehicles. The playset may include a plurality of rooms or regions, wherein each room or region may have specific decorations indicating a specific purpose. A child may use the playset to create play scenarios with the character toys.

A child may play with the playset in either of the two configurations. For example, in a collapsed configuration, a superstructure with rooms remains available for play. This same playset may be converted to an expanded configuration, in which a new environment for play is revealed between the first level and the second level. The new environment, in imaginative play, may be considered a secret or concealed place for the character toys.

The disclosed playsets may be open on one side to give a child access to an interior for play purposes. The playsets may resemble a building, such as a residence, castle, barn, or other building. The playsets may resemble any style of building as well, such as a modern skyscraper, a medieval castle, or a Tudor mansion. Further, the playset may resemble a fictitious or fanciful place, or a ship sailing on a wavy sea, transforming into an underwater castle.

Advantages of the present disclosure will be more readily understood after considering the drawings and the Detailed Description.

Figure 1:
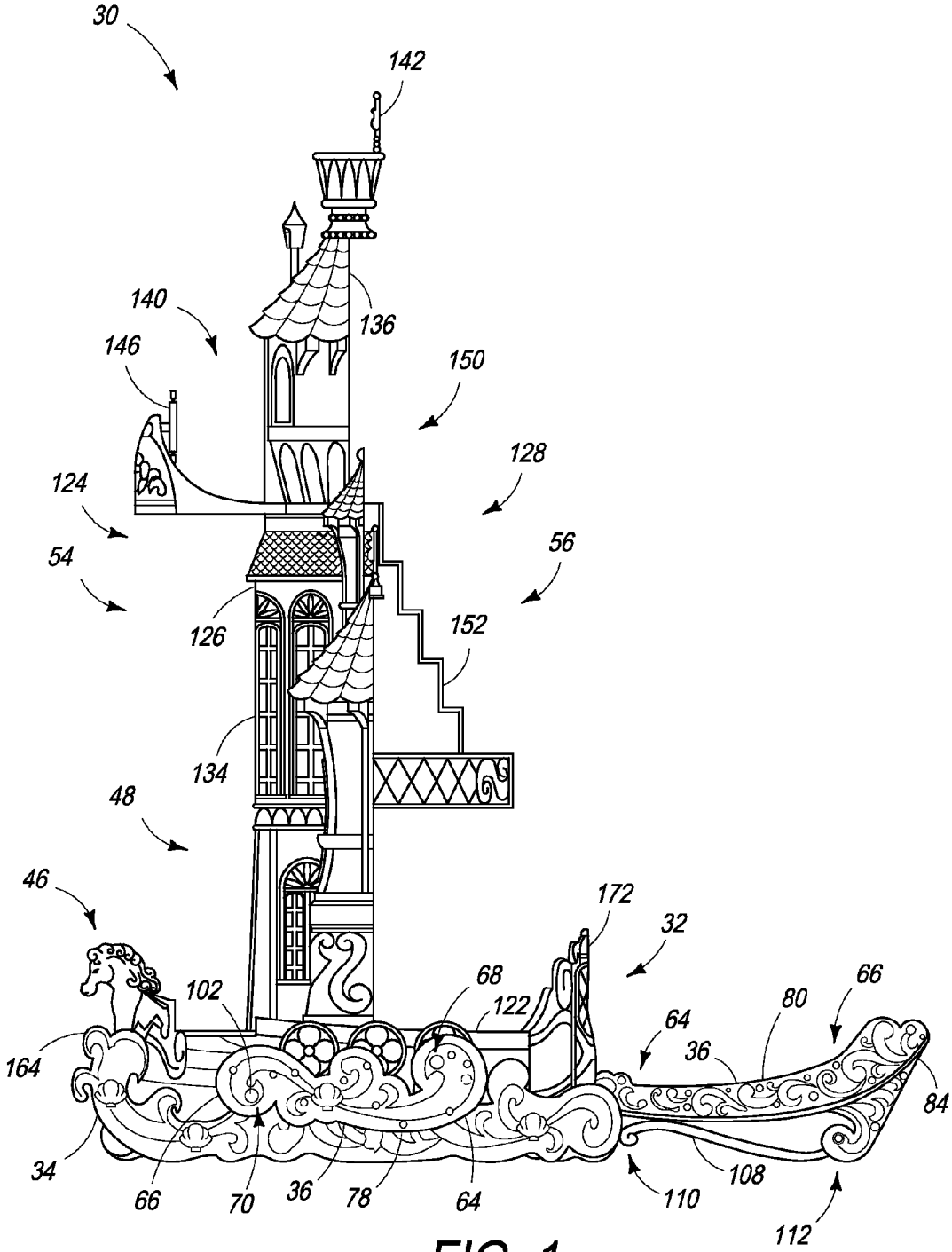
FIG. 1 is a side view of an expandable playset, shown in a collapsed configuration.
Figure 2:
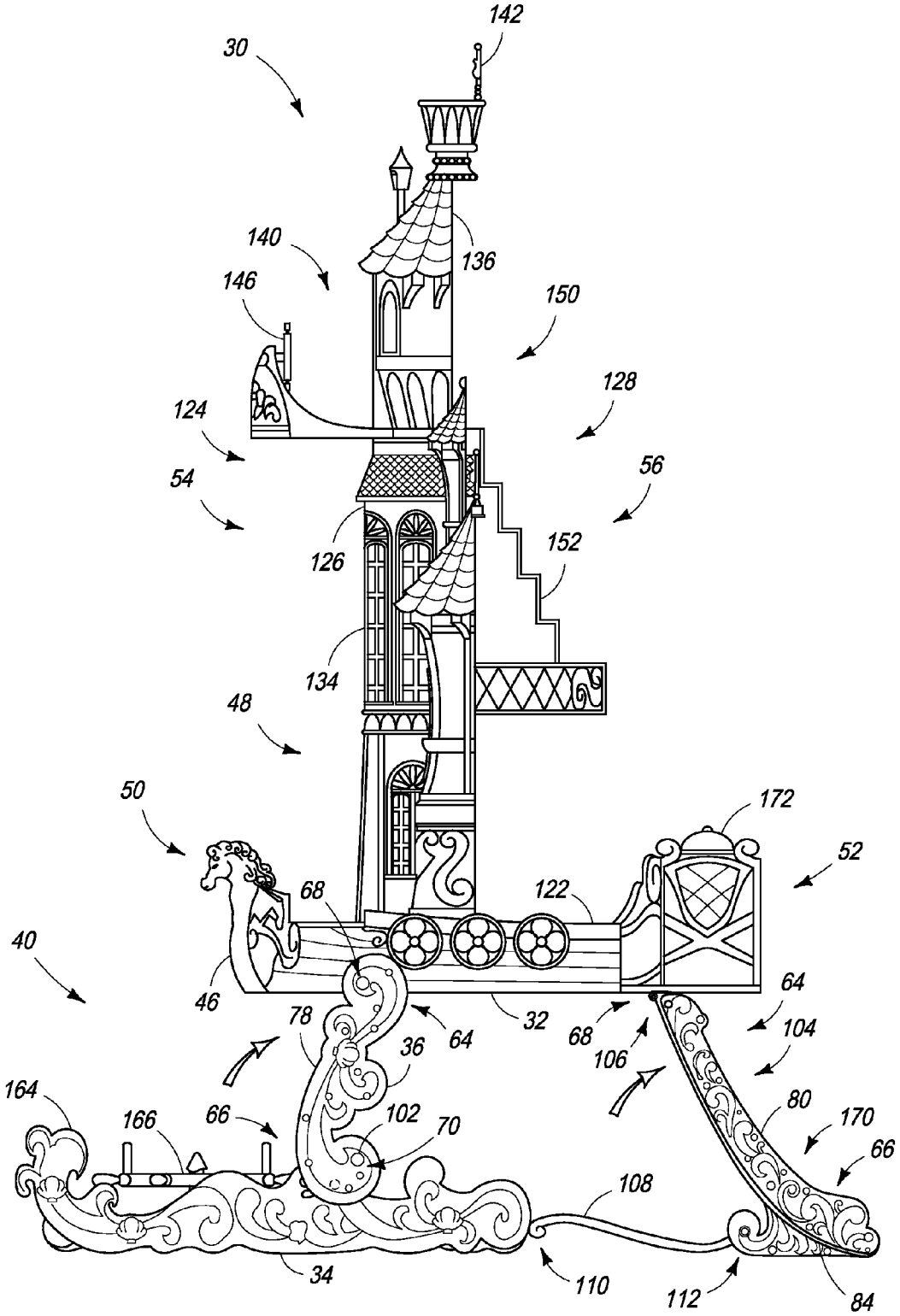
FIG. 2 is a side view of the expandable playset of FIG. 1, but shown in an expanded configuration.

The drawings illustrate embodiments and schematic concepts for expandable playsets according to the invention. The purpose of these drawings is to aid in explaining the principles of the invention. Thus, the drawings should not be considered as limiting the scope of the invention to the embodiments and schematic concepts shown therein. Other embodiments of an expandable playset may be created which follow the principles of the invention as taught herein, and these other embodiments are intended to be included within the scope of patent protection.

DETAILED DESCRIPTION OF THE DISCLOSURE

One embodiment of a playset 30 is shown in FIGS. 1-5, including an upper platform 32 and a base 34. Upper platform 32 may be movable relative to base 34 and may be connected to base 34 by a plurality of pivoting supports 36. Playset 30 may assume a first configuration or a second configuration, with the first configuration defined by upper platform 32 resting on top of and proximate to base 34, and the second configuration defined by upper platform 32 supported above base 34 by pivoting supports 36, providing an accessible play area 40 between upper platform 32 and base 34. Accessible play area 40 may be created by movement of playset 30 into the second configuration, as upper platform 32 may obstruct accessible play area 40 when playset 30 is in the first configuration. The first configuration and the second configuration may be referred to as a collapsed configuration and an expanded configuration, respectively.

Playset 30 may rest on a play surface S when in use, with base 34 being in contact with play surface S. Play surface S may be a table, floor, furniture seat, car seat, or other surface convenient for supporting toys in a child's real-world environment.

Base 34 may include one or more levels, a highest of which interacts with upper platform 32 and pivoting supports 36. Upper platform 32 may include one or more levels or structures; for example, a lowest portion of upper platform 32 may be fashioned as a boat 46 whereupon a superstructure 48 may be formed. In this example, boat 46 may be connected to pivoting supports 36, and may be movable from the collapsed configuration with boat 46 in contact with base 34, to the expanded configuration. An overall height of playset 30 measured from a lowest portion of base 34 to a highest portion of upper platform 32 may be greater when playset 30 is in the expanded configuration than when playset 30 is in the collapsed configuration.

For convention, a forward edge 50 of upper platform 32 may be defined as the edge of upper platform 32 furthest in the direction of travel as playset 30 moves into the collapsed configuration from the expanded configuration. Conversely, a rearward edge 52 of upper platform 32 may be defined as the edge of upper platform 32 furthest in the direction of travel as playset 30 moves into the expanded configuration from the collapsed configuration. Further, a front 54 of playset 30 may be defined by the part of playset 30 in the direction of forward edge 50, and a rear 56 of playset 30 may be defined by the part of playset 30 in the direction of rearward edge 52. An imaginary vertical plane VP, such as a sagital plane or a lateral plane, extending from front 54 to rear 56 of playset 30 defines a central plane of playset 30, and divides a first side 58 from a second side 60 of playset 30.

Terms such as "front", "rear", "upper", and "lower" used in this specification serve to aid in description of the disclosure, but in no way limit the disclosure per se. Directional descriptions are provided for ease in description of a single embodiment and the internal consistency of such a description. Embodiments of the disclosure, consistent with the claimed invention, are not invalidated by directional descriptions herein.

Playset 30 and any components thereof may be formed of molded plastic, for example, or from any suitable material or combination of materials.

Playset 30 may include at least two pivoting supports 36 positioned between upper platform 32 and base 34 including at least one front support 78 and at least one rear support 80. Each of pivoting supports 36 may have a first end 64 and a second end 66. First ends 64 of the pivoting supports 36 may be attached to upper platform 32, each forming an upper pivot 68. Second ends 66 of the pivoting supports 36 may be attached to base 34, each forming a lower pivot 70.

Pivoting supports 36 may be arranged in any suitable geometric pattern. For example, three pivoting supports 36 may be employed in an exemplary embodiment, including a first pivoting support 74 and second pivoting support 76 forming front supports 78 and a third pivoting support 80 forming a rear support. First pivoting support 74 and second pivoting support 76 may be positioned on first side 58 and second side 60 of playset 30 at a furthest distance from a midline of the playset. First pivoting support 74 and second pivoting support 76 may be positioned parallel to the midline with a direction of pivoting motion parallel to the midline as well. As the first pivoting support 74 and second pivoting support 76 each rotate about an upper pivot 68 and a lower pivot 70, each has an upper axis of rotation and a lower axis of rotation. For each front support 78 upper axis of rotation may be parallel with lower axis of rotation. As described, the upper axes of rotation of first pivoting support 74 and second pivoting support 76 may be aligned. Likewise, the lower axes of rotation of first pivoting support 74 and second pivoting support 76 may be aligned. Rear support 80 may be positioned aligned with the midline of playset 30 with a direction of pivoting motion aligned with the midline. Rear support 80 may be positioned medial to and generally equidistant from front supports 78. Upper axis of rotation of rear support 80 may be parallel with lower axis of rotation of rear support 80. Indeed, all axes of rotation of pivoting supports 36 around upper pivots 68 and lower pivots 70 may be parallel or aligned.

Pivoting supports 36 may rotate through a partial revolution relative to upper pivots 68 and lower pivots 70. Boundaries of the range of motion of pivoting supports 36 may be set on a first end by contact of upper platform 32 with base 34, i.e. in the collapsed configuration, and on a second end by a mechanical stop. The mechanical stop may interfere with the revolution of any, some, or all of the pivoting supports. In an exemplary embodiment, rear support 80 may be shaped with an integral rigid extended foot 84 that acts as a mechanical stop by contacting play surface S when rotated, for example when playset 30 is moved into expanded configuration.

The three upper pivots 68 define a horizontal plane, as do the three lower pivots 70. These two horizontal planes are generally parallel through an entire range of motion of upper platform 32 relative to base 34.

Expanded configuration may be made stable by any suitable means. For example, range of motion of front supports 78 may extend beyond vertical, thereby rendering the expanded configuration over-center. Weight of upper platform 32 and any additional force downward on upper platform 32 when playset 30 is in expanded configuration and upper platform is over-center compels rotation of pivoting supports 36 in the direction of the mechanical stop, rather than toward the collapsed configuration. Collapsed configuration may be inherently stable as force due to gravity acting on upper platform 32 rotates upper platform 32 toward base 34 upon which it rests.

Figure 3:
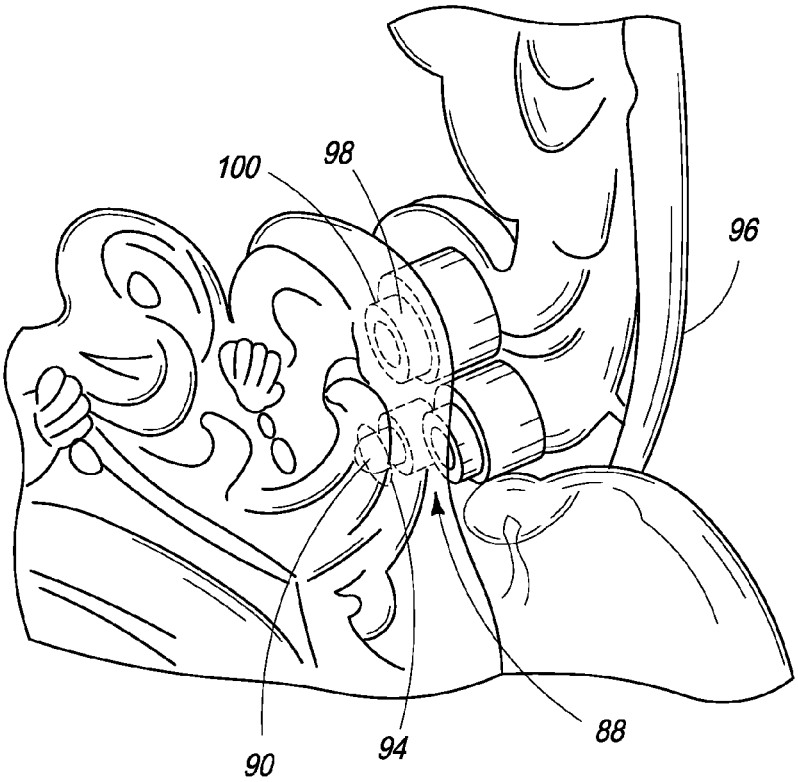
FIG. 3 is an isometric view of a portion of the expandable playset of FIGS. 1 and 2, shown in the expanded configuration, illustrating a pivot that connects a pivoting support to a base, and further illustrating a spring-loaded pin mechanism locking the pivoting support in a generally vertical position, corresponding to the expanded configuration shown in FIG. 2.
Figure 4:
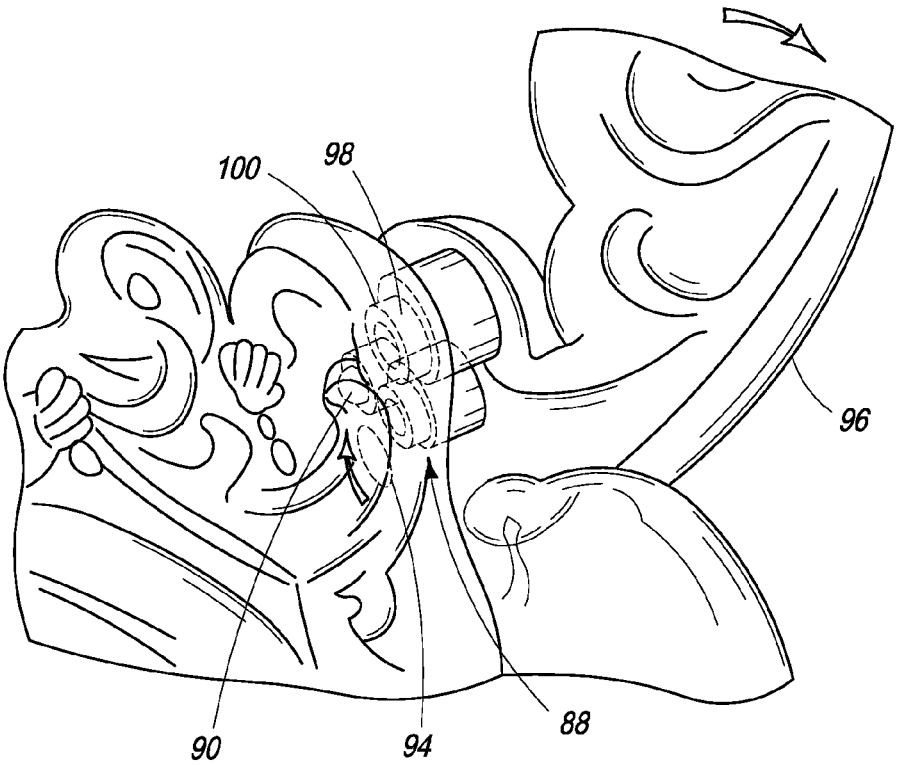
FIG. 4 is an isometric view of the portion of the expandable playset of FIG. 3, shown in a partially expanded configuration, with the spring-loaded pin mechanism that locks the pivoting support in the generally vertical position, shown here in a not engaged position.
Figure 5:
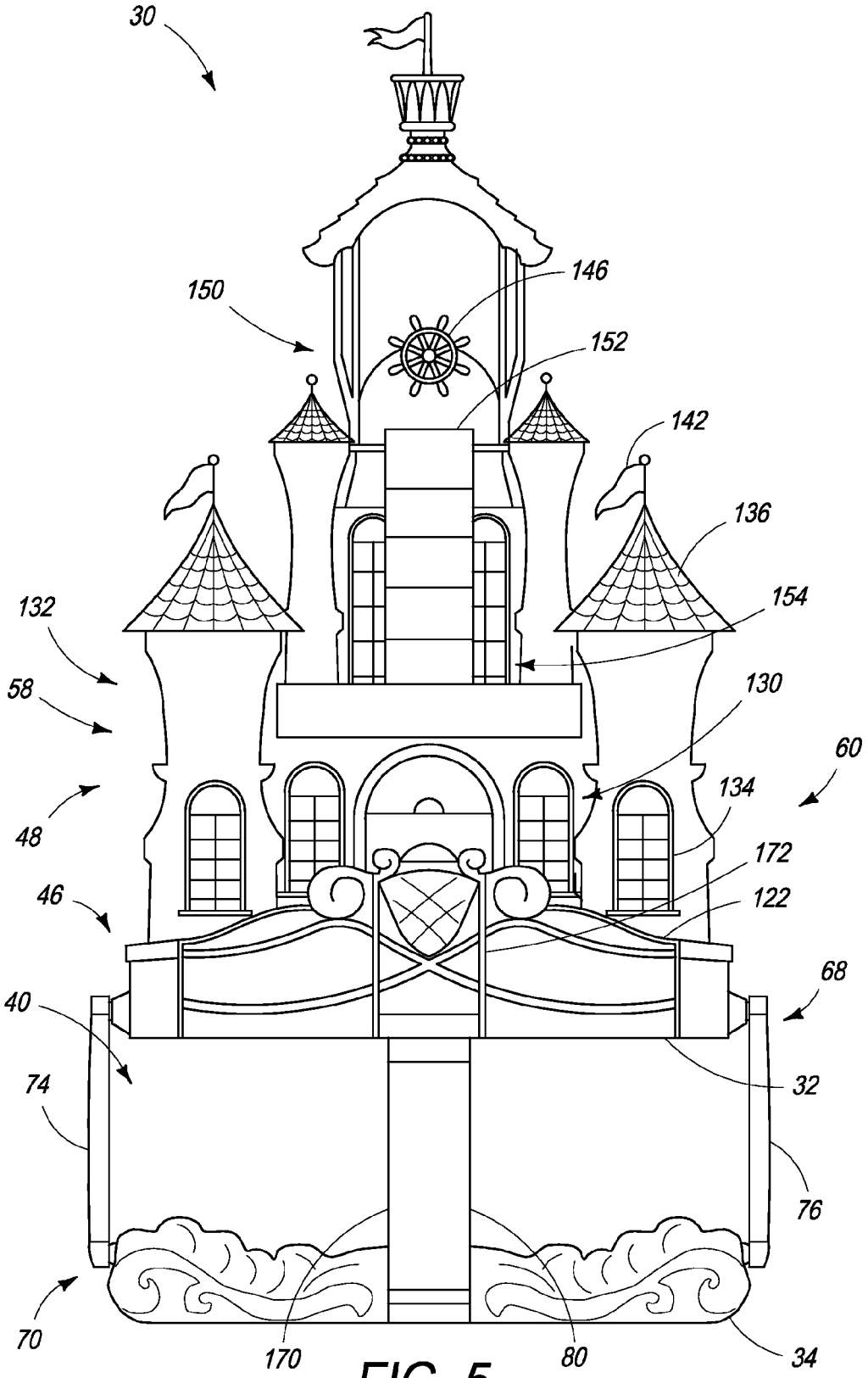
FIG. 5 is a rear view of the expandable playset of FIG. 2, shown in the expanded configuration.

Playset 30 may be equipped with a spring-loaded pin mechanism 88 as shown in FIGS. 3 and 4, to further stabilize either configuration. For example, a pin 90 biased to an extended position by a spring and deflectable against the spring, may be mounted on front support 78. Pin 90 may engage a recess 94 in base 34 when playset is in the expanded configuration, thereby locking or latching pivoting support 36 in a generally vertical position relative to base 34. Engagement of pin 90 into recess 94 may provide resistance to movement of upper platform 32 relative to base 34. FIGS. 3 and 4 show a representative embodiment of the current disclosure; however, an alternative embodiment may include a reciprocal arrangement of pin mechanism 88 and recess 90. For example, a pin mechanism 88 could be mounted on base 34, biased to engage a recess on a front support 78.

Each of first end 64 and second end 66 of pivoting supports 36 may be formed as a pivot by any suitable means, for example, in FIGS. 3 and 4 lower end 96 of front support 78 may be formed of molded plastic and include a cylindrical projection 98 that may fit into a cylindrical recess 100, in base 34. Lower end 96 of front support 78 may be attached to base 34 by a fastener such as a screw 102 holding projection 98 in recess 100. Alternatively, cylindrical projection 98 on front support 78 may be snapped into place with no fastener. Further examples include, in FIG. 2, upper end 104 of rear support 80 may be secured to upper platform 32 by a hinge pin 106 around which rear support 80 may rotate. Alternatively, upper end 104 of rear support 80 may, instead, include a first cylindrical projection and a second cylindrical projection extending collinearly from opposite sides of upper end 104, each of which may be positioned into corresponding recesses in upper platform 32.

Rear support 80 may be attached to a pivoting base extension 108 from base 34 instead of to base 34 directly. Base extension may be connected at a first end to base 34 by a base to extension pivot 110, and may be connected at a second end to rear support 80 by a base extension to lower rear support pivot 112. Use of a pivoting base extension 108 allows for a rear support 80 that is longer than front supports 78, the length measured between upper pivot 68 and lower pivot 70 of each pivoting support 36. Further, because of its increased length, rear support 80 travels an arc with a shorter angle measure than front supports 78. For example, front supports 78 may travel past vertical but rear support 80 may not. The result of this geometry is that in the expanded configuration, the front supports 78 and rear support 80 are angled toward each other, resulting in a more stable structure than if all supports were angled in the same direction.

Upper platform 32 may resemble a boat 46 which may include a superstructure 48. Boat 46 may include features such as decking and bulwarks 122. Superstructure 48 may be in the form of a dollhouse and may resemble a residence such as a castle, house, or other structure. Superstructure 48 may include a front 124 forming an exterior wall 126 of superstructure 48 and a rear 128 which may be open and allow access to an interior 130 of superstructure 48. Superstructure 48 may further include a plurality of building segments such as towers 132.

Front of superstructure 124 may include decorative, functional, or structural features consistent with the exterior of a residence. These features may include an exterior wall surface 126, a window 134, a roofing surface 136, a gate, a balcony 140, a flag 142, or a plurality of any of these features and others. Superstructure 48 may include features consistent with a boat as well, such as a sail, or a steering wheel 146.

Rear of superstructure 128 may be open to allow access to an interior of superstructure 130. Superstructure 48 may include a plurality of levels 150. Between levels 150, in interior 130, superstructure 48 may include stairs 152. Stairs 152 may be rotatable on a vertical axis. Interior 130 may include a plurality of rooms 154, each with features which may include flooring, windows 134, furniture, pillars, and other decorative, functional, or structural features.

Base 34 may resemble a body of water with accessible play area 40 resembling a secret, underwater play space. Base 34 may include features consistent with an underwater theme including, for example, waves 164, a folding seashell seat, or a spinning ship's wheel 166.

Pivoting supports 36 may be formed with decorative and/or functional features. Pivoting supports 36 may include decorative waves 164 or other features. Rear support 80 may resemble a slide 170 such as a playground slide. Slide 170 may be in a perceived functional orientation when playset 30 is in expanded configuration, and may provide imagined access for play characters from boat 46 to accessible play area 40. Boat 46 may include an operable door 172 in bulwarks 122 adjacent slide 170 to allow characters access to slide 170.

While embodiments of an expandable playset have been particularly shown and described, many variations may be made therein. This disclosure may include one or more independent or interdependent embodiments directed to various combinations of features, functions, elements and/or properties. Other combinations and sub-combinations of features, functions, elements and/or properties may be claimed later in a related application. Such variations, whether they are directed to different combinations or directed to the same combinations, whether different, broader, narrower or equal in scope, are also regarded as included within the subject matter of the present disclosure. Accordingly, the foregoing embodiments are illustrative, and no single feature or element, or combination thereof, is essential to all possible combinations that may be claimed in this or a later application.

It is believed that the disclosure set forth herein encompasses multiple distinct inventions with independent utility. While each of these inventions has been disclosed in its preferred form, the specific embodiments thereof as disclosed and illustrated herein are not to be considered in a limiting sense as numerous variations are possible. Each example defines an embodiment disclosed in the foregoing disclosure, but any one example does not necessarily encompass all features or combinations that may be eventually claimed. Where the description recites "a" or "a first" element or the equivalent thereof, such description includes one or more such elements, neither requiring nor excluding two or more such elements. Further, ordinal indicators, such as first, second or third, for identified elements are used to distinguish between the elements, and do not indicate a required or limited number of such elements, and do not indicate a particular position or order of such elements unless otherwise specifically stated.

The following reference numerals appear in the drawings:

| | |
|---|---|
| 30 | Playset |
| 32 | Upper platform |
| 34 | Base |
| 36 | Pivoting supports |
| 40 | Accessible play area |
| 46 | Boat |
| 48 | Superstructure |
| 50 | Forward edge of upper platform |
| 52 | Rearward edge of upper platform |
| 54 | Front of playset |
| 56 | Rear of playset |
| 58 | First side of playset |
| 60 | Second side of playset |
| 64 | First end of pivoting support |
| 66 | Second end of pivoting support |
| 68 | Upper pivot |
| 70 | Lower pivot |
| 78 | Front support |
| 74 | First pivoting support |
| 76 | Second pivoting support |
| 80 | Rear support |
| 84 | Integral rigid extended foot |
| 88 | Spring-loaded pin mechanism |
| 90 | Pin |
| 94 | Pin recess |
| 96 | Lower end of front support |
| 98 | Cylindrical projection |
| 100 | Cylindrical recess |
| 102 | Screw |
| 104 | Upper end of rear support |
| 106 | Hinge pin |
| 108 | Base extension |
| 110 | Base to extension pivot |
| 112 | Base extension to lower rear support pivot |
| 122 | Bulwarks |
| 124 | Front of superstructure |
| 126 | Exterior wall of superstructure |
| 128 | Rear of superstructure |
| 130 | Interior of superstructure |
| 132 | Tower |
| 134 | Window |
| 136 | Roofing surface |
| 140 | Balcony |
| 142 | Flag |
| 146 | Steering wheel |
| 150 | Levels |
| 152 | Stairs |
| 154 | Rooms |
| 164 | Waves |
| 166 | Spinning ship's wheel |
| 170 | Slide |
| 172 | Door |

What is claimed is:

1. An expandable playset, comprising:

a base for resting on a play surface;

an upper platform movable relative to the base;

at least one front support interposed the base and the upper platform, connected by a front base pivot to the base, and connected by a front upper pivot to the upper platform;

at least one rear support, operably connected by a rear base pivot to the base, and connected by a rear upper pivot to the upper platform;

wherein:

the playset is movable into two positions, including a first position where the upper platform rests on and proximate the base, and a second position where the upper platform rests on the front support and the rear support, distant from the base; and the rear support includes an integral rigid extended foot that projects upwardly when the upper platform is adjacent the base, and that contacts the play surface when the upper platform is lifted to be distant from the base.

2. The playset of claim 1, wherein movement of the playset from the first position to the second position rotates the front support beyond the vertical position so that the two positions are inherently stable, the first position stable because force due to gravity acting on the upper platform rotates the upper platform toward the base upon which it rests, and the second position stable because force due to gravity acting on the upper platform rotates the integral rigid extended foot of the rear support toward the play surface upon which it rests.

3. The playset of claim 2, wherein a spring-loaded, deflectable pin is mounted interposed the front support and the base, and the second position of the playset is further stabilized by engagement of the pin into a recess when the playset is moved into the second position.

4. The playset of claim 3 wherein, the upper platform is supported by two front supports positioned laterally, relative to the upper platform, and generally parallel to each other, and a single rear support positioned generally medial to and equidistant from the front supports.

5. The playset of claim 4 further comprising an extension interposed the base and a lower end of the rear support, wherein the extension has a first end and a second end, the first end pivotably connected to the base, and the second end pivotably connected to the rear support, whereby the lower end of the rear support rests on the supporting surface when the playset is in the first position or second position, but may be lifted from the supporting surface, by movement of the pivoting extension, when the playset is transitioned between the two positions.

6. The playset of claim 5 wherein the length of the rear support between the upper pivot and the lower pivot is greater than the length of the front support between the upper pivot and the lower pivot.

7. The playset of claim 6 wherein an accessible play area between the base and the upper platform is created when the playset is moved into the second position from the first position.

8. The playset of claim 7 wherein the overall height of the playset is increased by movement of the playset between the first position and the second position.

9. The playset of claim 8 further comprising:

a structure in the form of a dollhouse positioned on the upper platform including a front formed as an exterior of a residence, and a rear being open to allow access to an interior of the dollhouse.

10. The playset of claim 9 further comprising a staircase rotatable on a vertical axis.

11. An expandable playset, comprising a base resting on a play surface, and a structure connected by a plurality of pivoting supports to the base, each support connected to a portion of the structure by an upper pivot, and each support connected to a portion of the base by a lower pivot, the playset configurable into two positions, a first position wherein the structure rests on the base, and a second position wherein the structure rests on the supports elevated substantially above the base, the playset biased to remain in one of the two positions by an over-center rotation of at least one of the plurality of pivoting supports, the one pivoting support having a range of motion including two ends on opposite sides of a vertical orientation, one end of the range of motion determined by contact of the structure with the base, and the other end determined by contact of a pivoting support with a mechanical stop.

12. The playset of claim 11 wherein at least one of the plurality of pivoting supports includes an integrally formed rigid extended foot and the mechanical stop is provided by contact of the foot with the play surface.

13. The playset of claim 12 wherein at least one of the plurality of pivoting supports is a front pivoting support with a range of motion including two ends on opposite sides of a vertical orientation, and at least one of the plurality of pivoting supports is a rear pivoting support including an integrally formed rigid extended foot.

14. The playset of claim 13 including two front pivoting supports positioned laterally and generally parallel each other, and one rear pivoting support positioned medial to and generally equidistant from the front supports.

15. The playset of claim 14 further comprising at least one pin mechanism mounted on a front support including a pin biased by a spring to be extended, and a recess on the base, wherein when the playset is in the second position, the pin engages the recess and the second position is stabilized by engagement of the pin into the recess.

16. The playset of claim 14 further comprising at least one pin mechanism mounted on the base including a pin biased by a spring to be extended, and a recess on a front support, wherein when the playset is in the second position, the pin engages the recess and the second position is stabilized by engagement of the pin into the recess.

17. An expandable playset, comprising:

a lower portion resting on a play surface, an upper portion connected to the lower portion by at least one front support and at least one rear support, the front support having two ends, an upper end connected to the upper portion at an upper pivot and a lower end connected to the lower portion at a lower pivot, the rear support having two ends, an upper end connected to the upper portion at an upper pivot and a lower end connected to the lower portion at a lower pivot, the playset configurable into two positions, a first position, wherein the upper portion rests on the lower portion, and a second position wherein the upper portion rests on the front and rear supports, supported substantially above the lower portion, the front support and the rear support each having a range of motion including two ends, a first end corresponding to the first position of the playset and a second end corresponding to the second position of the play set, wherein the two ends of the range of motion of the front support are on opposite sides of the vertical position of the front support, and the second end of the range of motion of the rear support is defined by contact of a foot projection with the play surface.

18. The playset of claim 17 wherein the rear support is connected to the lower portion via a pivoting extension, the extension having a first end and a second end, the first end pivotably connected to the lower portion, and the second end pivotably connected to the rear support, whereby the lower end of the rear support rests on the supporting surface when the playset is in the first position or second position, but may be lifted from the supporting surface, by movement of the pivoting extension, when the playset is transitioned between the two positions.

19. A playset comprising:

a base;

an upper platform;

a pivoting vertical support extending from a lower pivot connected to the base to an upper pivot connected to the upper platform; and a pivoting angled support extending from a proximal pivot connected to the upper platform; and a base extension removably interconnecting the base to a distal pivot connected to the angled support, wherein:

the upper platform may rest adjacent to the base thereby obstructing a substantial portion of the base from being used as a play area, with the upper pivot adjacent a front end of the base, the lower pivot located generally between the upper pivot and the distal pivot, and the proximal pivot located generally between the lower pivot and the distal pivot;

the upper platform may be translated relative to the base by being lifted above the base, with the pivoting vertical support and the pivoting angled support defining a path of motion for the upper platform; and the vertical support may be latched in a vertical position to stably support the upper platform in an expanded configuration thereby exposing a substantial portion of the base to allow use as a play area.

20. The playset of claim 19, wherein at least one of the angled support and the base extension may be disconnected from the upper platform or the base, respectively, or disconnected from each other, allowing the angled support and the base extension to be folded to overlap the base, thereby reducing an overall length of the playset.

* * * * *